United States Patent [19]

Hadden-Wight et al.

[11] 4,082,593

[45] Apr. 4, 1978

[54] PRINTING ON THE SIDES OF PAPER PADS

[75] Inventors: Roger Hadden-Wight, Chertsey; Colin Stanley Johnson, Camberley, both of England

[73] Assignee: Irvin Bros. (Fleet Works) Limited, England

[21] Appl. No.: 699,209

[22] Filed: Jun. 23, 1976

[30] Foreign Application Priority Data

Jun. 25, 1975 United Kingdom ..... 26966/75

[51] Int. Cl.[2] ..... B44C 1/24

[52] U.S. Cl. ..... 156/230; 8/2.5 A; 101/32; 101/470; 427/148

[58] Field of Search ..... 101/469.32, 470, 471; 8/2.5 A; 156/230; 427/148

[56] References Cited

U.S. PATENT DOCUMENTS

| | | | |
|---|---|---|---|
| 6,471 | 5/1849 | Davis | 156/230 |
| 203,568 | 5/1878 | Tuchfarber | 156/230 |
| 220,619 | 10/1879 | Hudson et al. | 156/230 |
| 391,346 | 10/1888 | Turner | 427/148 |
| 393,919 | 12/1888 | Oliver | 427/148 |
| 3,054,715 | 9/1962 | White | 101/27 |
| 3,245,796 | 4/1966 | Burg | 96/67 |
| 3,246,600 | 4/1966 | Wartman et al. | 101/129 |
| 3,280,735 | 10/1966 | Clark et al. | 101/471 |
| 3,357,353 | 12/1967 | Teuscher | 101/469 |
| 3,684,544 | 8/1972 | Piron | 156/240 |
| 3,863,598 | 2/1975 | Roper | 118/202 |
| 3,966,396 | 6/1976 | Howes et al. | 101/470 |

FOREIGN PATENT DOCUMENTS

| | | | |
|---|---|---|---|
| 137,036 | 3/1961 | U.S.S.R. | 101/470 |

*Primary Examiner*—Clyde I. Coughenour
*Attorney, Agent, or Firm*—Watson, Cole, Grindle & Watson

[57] ABSTRACT

A method of applying multi-colored visible matter to a side surface of a pad or block of sheets of paper by a transfer printing process wherein a substrate having multi-colored inks thereon is applied to the side surface and heat and pressure are then applied to the substrate in order to transfer the inks to the side surface of the pad or block of sheets.

8 Claims, No Drawings

PRINTING ON THE SIDES OF PAPER PADS

BACKGROUND OF THE INVENTION

This invention relates to pads or blocks of sheet material, such as pads or blocks of paper. These may be pads of the kind having a flat surface defined by a straight edge of the sheets, these straight edges being stuck together so that this flat surface defines a hinge or spine of the pad. In the case of a writing pad or notepad, for example, the sheets may be detached one at a time by tearing them off from the hinge or spine surface. In the case of other forms of pads or blocks, the sheets may be intended to be permanently stuck together so that they form leaves or pages in the manner of a book. Any such form of pad or block will be referred to as 'a pad of the kind specified.'

It is sometimes desirable to provide visible matter on at least one side surface of a pad of the kind specified. The side surface may be the hinge or spine surface, or it may be any side surface of the pad defined by an edge of each of the sheets which constitute the pad. Such visible matter may be decorative or may have a utilitarian or functional purpose. For example, it may be desirable to provide a notepad having on one or more of its side surfaces visible matter in the form of advertising material or the like.

It is known to make a pad of the kind specified which carries visible matter on at least one of its side surfaces by applying the visible matter to the pad by a silk screen printing process. However, difficulties sometimes arise in applying the visible matter by a silk screen printing process, particularly where it is necessary to make more than one application of visible matter to the side surface, e.g., in the case of multi-color printing. One such difficulty is in securing sufficiently accurate registration of the successive silk screens to ensure a high quality print time after time in a repetition process. One cause of this difficulty, particularly in the case of a thick pad consisting of a large number of sheets, is that it may not be feasible to clamp the pad sufficiently tightly to ensure that there is no relative movement between any of the sheets during the successive stages of the printing process.

The present invention provides an improved method of applying visible matter to a side surface of a pad of the kind specified. The advantages of the invention are particularly manifest where multi-color visible matter is to be applied to one or more of the side surfaces of a thick pad.

SUMMARY OF THE INVENTION

According to the present invention a method of applying visible matter to at least one side surface of a pad of the kind specified comprises: (1) taking a transfer comprising the visible matter as a surface layer on a substrate; (2) placing the transfer with the surface layer in contact with a side surface of the pad; (3) applying heat and pressure to the substrate to affix the surface layer of visible matter to the side surface of the pad; and (4) thereafter removing the substrate.

In the case where a multi-color application is to be made, the transfer itself will carry the multi-color material in the surface layer on the substrate and the several colors will be applied simultaneously to the pad, so that no problems of registration of successive color imprints will arise.

The side surface of the pad to which the visible matter is to be applied may be any of the side surfaces, including the hinge or spine surface.

The transfer may be made by forming an imprint, e.g., a multi-color imprint, on a suitable substrate. The substrate may be a sheet of paper having a vapor repellant surface coating, e.g., an agar-derived coating such as that available under the trade name "Hycosol." The imprint may be made with a suitable ink capable of being transferred from the substrate to the side surface of the pad by the application of heat and pressure to the substrate, such as a vapor diffusion ink. Such inks are known in the art, e.g., for transfers for applying patterns or pictures to synthetic textile fabrics. Suitable inks are available under the trade name "MarlerTex."

Certain inks useful for making transfers do not transfer well to the side surfaces of a pad of sheets of paper but have better adhesion to, for example, some synthetic polymeric materials. In such a case, satisfactory transfer may be achieved by first applying to the side surface of the pad a coating of a suitable material, e.g., of varnish based on a synthetic plastics material which is compatible with the ink of the transfer material.

Alternatively, the transfer may include a layer of such a suitable material over the layer of visible matter such that the layer of suitable material becomes disposed between the paper and the visible matter on application to the pad.

To obtain satisfactory transfer of the visible matter from the substrate to the side surface of the pad it is necessary that heat and pressure should be applied uniformly over the substrate. The transfer can therefore most simply be applied to a flat side surface of a pad, the heat and pressure being applied by the use of a press having a heated flat platen. A roller, preferably a heated roller, may, however, be used.

The heat and pressure necessary to give the optimum transfer of visible matter from the substrate to the side surface of the pad will vary considerably, depending on the nature of the materials used. The best combination of pressure and temperature can be ascertained by simple experiments. The pressure applied to the transfer to affix the visible matter to the pad may, for example, be in the range from 75 to 125 pounds per square inch, e.g. 100 pounds per square inch, and the application temperature in the range 200° to 300° C, e.g. 250° C, for an application time in the range from 10 seconds to one minute, e.g. 20 seconds.

The invention resides not only in the method of applying the visible matter to the pad, but to a pad carrying visible matter which has been applied by the method.

Also, according to another aspect of the invention, a pad of the kind specified has on at least one of its side surfaces multi-color visible matter which has been applied to the side surface from a transfer in a single transfer operation.

A particularly striking product can be achieved by applying a multi-color imprint to the four side surfaces of a pad consisting of a stack of square sheets of paper, the height of the pad being equal to the length of a side of a sheet so that the pad is in the form of a cube. One of the four side surfaces constitutes the hinge or spine of the pad.

What we claim is:

1. A method of applying multi-colored visible matter to at least one side surface of a pad of sheet materials in a single operation comprising:

(a) placing a transfer, which comprises a substrate having a first layer of multi-colored visible inks to be applied to the pad of sheet materials and a second layer of varnish based on synthetic plastics material which is compatible with said multi-colored inks, in contact with at least one side surface of the pad of sheet materials such that the layer of varnish contacts said at least one side surface of the pad of sheet materials, (b) heating said substrate to a temperature of 200° to 300° C and applying a pressure to said substrate of 75 to 125 pounds per square inch for a time period of 10 seconds to 1 minute so as to affix the layer of varnish and the layer of multi-colored visible inks to the adjacent side surface of the pad of sheet materials, and (c) removing said substrate.

2. A method as claimed in claim 1 wherein said steps (a), (b) and (c) are accomplished with respect to each of four side surfaces of the pad.

3. A method as claimed in claim 1 wherein said substrate is composed of paper having a vapor-repellant surface coating.

4. A method as claimed in claim 1 wherein prior to placing the transfer in contact with the at least one side surface of the pad said at least one side surface of the pad is coated with a layer of material which is compatible with said multi-colored inks.

5. The method as claimed in claim 4 wherein the material compatible with the multi-colored inks is a varnish based on synthetic plastic material.

6. A method as claimed in claim 1 wherein the transfer is placed in contact with the at least one side surface of the pad using a roller.

7. A pad of sheet material which has multi-colored visible matter affixed to at least one side surface thereof which has been affixed by the method of claim 1.

8. The method as claimed in claim 1 wherein said method consists of said steps (a), (b) and (c).

* * * * *